United States Patent [19]

Johnson

[11] 4,098,344

[45] Jul. 4, 1978

[54] EARTHWORKING IMPLEMENT

[76] Inventor: Victor Ray Johnson, Box 181, Erwin, N.C. 28339

[21] Appl. No.: 730,166

[22] Filed: Oct. 7, 1976

[51] Int. Cl.[2] ..... A01B 35/18

[52] U.S. Cl. ..... 172/40; 172/68; 172/175; 172/199

[58] Field of Search ..... 172/40, 149, 150, 175, 172/63, 42, 199, 68; 37/10

[56] References Cited

U.S. PATENT DOCUMENTS

| | | | |
|---|---|---|---|
| 620,034 | 2/1899 | Hedges | 172/150 |
| 955,590 | 4/1910 | Grimes | 37/10 |
| 1,238,497 | 8/1917 | Connelly | 172/150 X |
| 2,671,386 | 3/1954 | Kerridge | 172/40 X |
| 2,965,053 | 12/1960 | Gruber | 172/149 X |
| 3,363,423 | 1/1968 | Davis | 172/40 X |
| 3,757,869 | 9/1973 | Gagne | 172/40 |
| 3,889,760 | 6/1975 | Manor | 172/175 |

FOREIGN PATENT DOCUMENTS

| | | | |
|---|---|---|---|
| 2,113,320 | 10/1972 | Fed. Rep. of Germany | 172/40 |

*Primary Examiner*—Paul E. Shapiro
*Attorney, Agent, or Firm*—Mills & Coats

[57] ABSTRACT

The present invention relates to an earthworking implement or attachment adapted to be connected to and powered by a prime mover such as a tractor, front-end loader, or the like. More particularly, the earthworking implement of the present invention is designed to spread and level dirt and soil material in one operation, and thereafter to appropriately generally tamp, pack or compress the dirt or material to a desired density which may customarily be done in layers. Structurally, the earthworking implement or attachment of the present invention comprises a frame structure having a ground engaging roller, sometimes referred to as a tamping roller, rotatively mounted therein, with the frame structure having a blade disposed forwardly thereacross. A driven counterweight assembly is also on the frame structure and when driven the counterweight assembly imparts a vibratory-massaging action causing the roller to tamp, compress, or massage the dirt or soil being passed thereover. To perform a leveling or spreading operation, the frame structure of the immplement is rotated about the axis of rotation of the ground engaging roller to a point where the lower portion of the blade is in a proper position to spread or level dirt or soil material. To accommodate the tamping operation, the frame structure is pivoted with respect to the ground engaging roller about the axis of rotation thereof to a position where the lower edge of the blade substantially clears the ground surface line and consequently as far as spreading and leveling is generally inoperative.

8 Claims, 4 Drawing Figures

FIG. 1
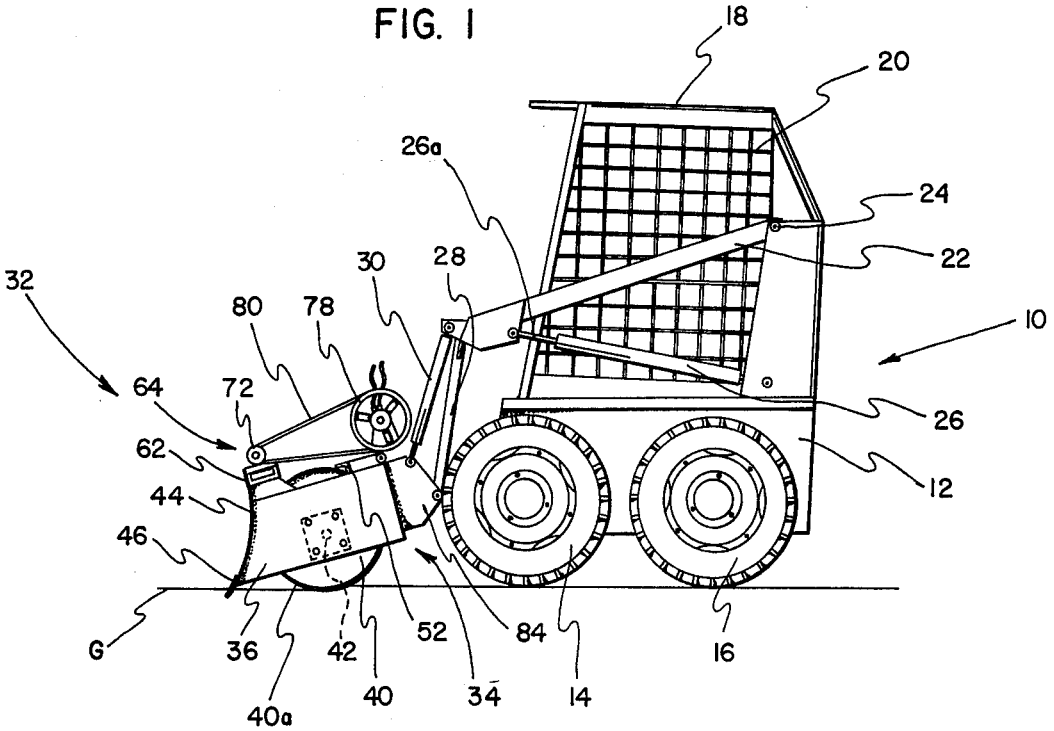
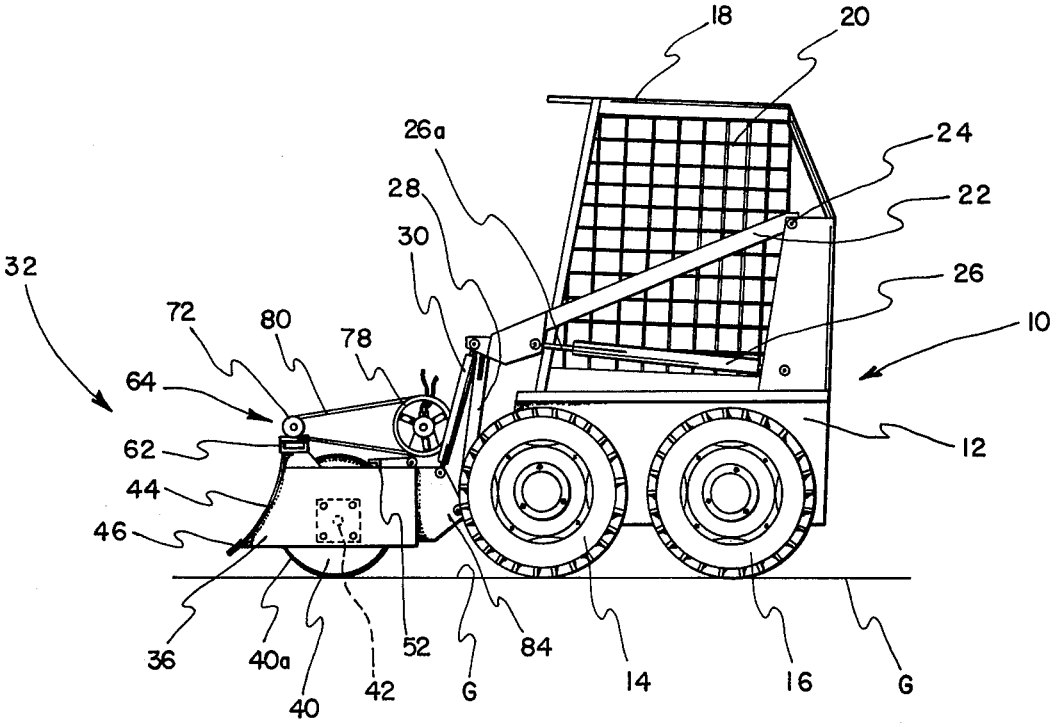
FIG. 2

EARTHWORKING IMPLEMENT

The present invention relates to earthworking equipment and implements, and more particularly to an overworking implement for attachment used in filling ditches, trenches or generally filling or spreading dirt or soil material over an area wherein the earthworking implement or attachment is adapted to both level and spread the soil or dirt material and to also perform a packing, compressing or tamping action on the generally loosely disposed dirt or soil material, wherein the implement is adapted to perform either basic function independently of the other.

BACKGROUND OF THE INVENTION

Today Government regulations require that ditches or trenches dug for installing such utility equipment as water and sewer pipes and the like be refilled according to certain guidelines and specifications. Principally such regulations aim at assuring that the dirt and soil used in the refilling operation is properly placed during refilling, which generally requires spreading approximately 6 inches of loose dirt or soil in the ditch or trench, followed by a tamping or packing operation. This is repeated until the ditch or trench is filled, and, therefore, it follows that in effect the ditch or trench is refilled in layers. By this process, it is assured that a generally stable soil profile of a generally uniform density throughout results.

Usually such ditches or trenches are approximately 3-foot wide and it is, therefore, appreciated that a substantial volume of dirt or soil is involved in a major project. One can readily appreciate the large amount of labor and time required to fill such ditches and trenches in major projects where a substantial portion of the work must be done by manual labor which is often required because the ditch or trench of a 3-foot width is relatively narrow, and it is very difficult to provide automatic earthworking equipment that is capable of performing the spreading and tamping operations within a 3-foot ditch properly and efficiently.

SUMMARY OF THE INVENTION

The present invention presents an earthworking implement in the form of an attachment for a tractor, front-end loader, or the like wherein the attachment is adapted to perform both spreading and tamping operations in a relatively narrow ditch or trench, even as narrow as approximately 3 feet. In addition, the earthworking implement of the present invention is adapted to be used in other earthworking applications requiring spreading, leveling or tamping and particularly designed such that the dirt or soil spreading or leveling operation can be performed separately and independently of the tamping operation, and vice versa.

More particularly, the earthworking implement of the present invention comprises a frame structure having a ground engaging roller rotatively mounted therein and wherein said frame structure includes a front transverse blade that is adapted to be moved between a lower ground engaging leveling position and elevated inoperative position where the lower edge of said blade is raised above the ground level. The movement of the blade between the ground engaging position and the inoperative position is accomplished by generally rotating the entire frame structure of the implement about the axis of rotation of said ground engaging roller. In addition, to give the earthworking implement or attachment of the present invention the capacity to tamp, the frame structure is provided with a hydraulically driven counterweight assembly that imparts to the frame structure and the ground engaging roller associated therewith a vibratory like massaging action.

As disclosed in the preferred embodiment, the earthworking implement or attachment of the present invention is particularly adapted to be connected to the front remote end of a boom structure extending from a tractor or front-end loader where the same ground engaging implement or attachment may be lifted and/or controlled by conventional hydraulic cylinders associated with the boom structure.

It is, therefore, an object of the present invention to provide an earthworking implement adapted to spread and generally level filling dirt over a particular area, and in addition, capable of applying a tamping or compacting action to dirt so spreaded or leveled.

Another object of the present invention is to provide an earthworking implement having the capabilities enumerated immediately above wherein the earthworking implement is relatively simple, inexpensive but yet effective and efficient in operation.

A further object of the present invention is to provide an earthworking implement in the form of an earth leveling and tamping attachment adapted to easily, conveniently, and readily attach to a tractor, front-end loader or the like, and which can operate in relatively small areas or ditches.

Still a further object of the present invention is to provide an earthworking attachment or implement for leveling and tamping dirt or soil material wherein said attachment or implement may be readily adjusted to level or tamp independently or simultaneously.

Other objects and advantages of the present invention will become apparent from a study of the following description and the accompanying drawings which are merely illustrative of the present invention.

BRIEF DESCRIPTION OF THE DRAWINGS

FIG. 1 is a side elevational view of the earthworking implement of the present invention wherein the same is shown in the form of an attachment connected to the boom structure of a conventional front-end loader, and wherein the earthworking implement is positioned such that the blade thereof is in a generally ground engaging position for spreading or leveling dirt or soil material.

FIG. 2 is also a side elevational view of the earthworking implement referred to above and shown in FIG. 1 with the blade raised to an elevated position where a ground engaging roller forming a part of the implement may be used solely in a tamping or compacting operation.

DESCRIPTION OF PREFERRED EMBODIMENT

Figure 3:
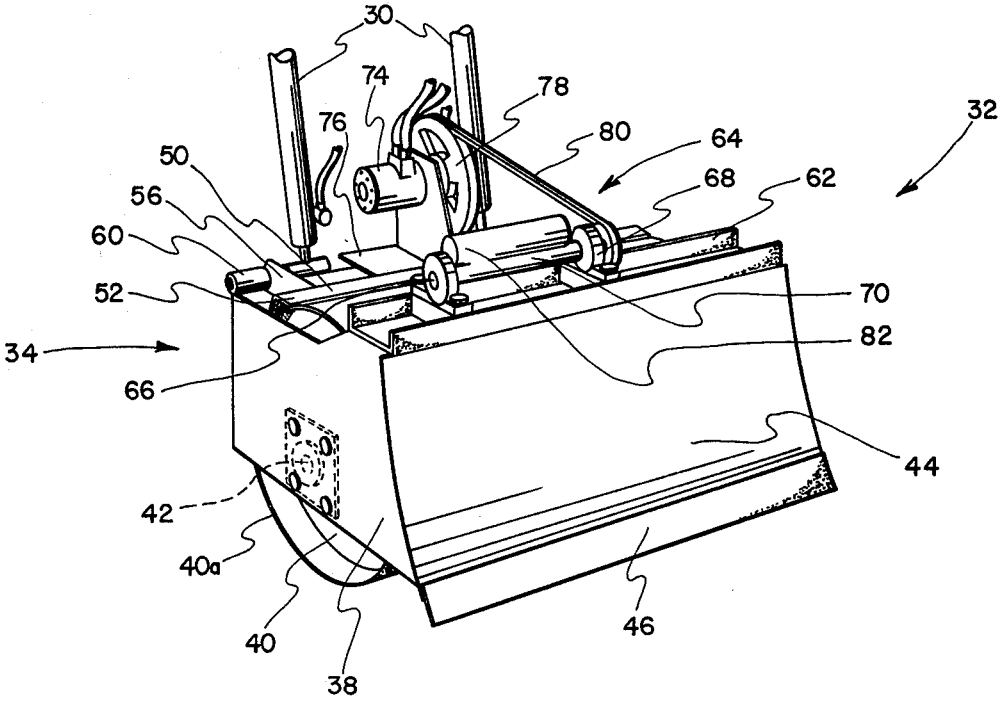
FIG. 3 is a perspective view of the earthworking implement or attachment of the present invention as viewed from the front and to one side.

With further reference to the drawings, particularly FIGS. 1 and 2, a front-end loader is shown therein and indicated generally by the numeral 10. It will be appreciated that front-end loaders of the type shown in FIG. 1 are conventional and well known in the art, but for a unified and complete understanding of the present invention, a brief discussion will deal with the principal structural components thereof. In this regard, it is seen that loader 10 includes a main body frame 12 supported on each side by a pair of wheels 14 and 16. Defined within main body frame 12 is an operator's compartment that is surrounded by a protective cage 20 and a top 18.

Extending from loader 10 is a hydraulically actuated boom assembly or means 22 that is pivotably secured about the rear of the loader 10 about transverse axis 24 and is adapted to be raised and lowered with respect to the loader 10 by a lift cylinder 26 disposed on each side of the loader and anchored to the loader body frame 12 and extending therefrom is a rod end portion **26*a* of the cylinder which connects to the boom at a remote forward portion. Therefore, it is appreciated that the actuation of hydraulic lift cylinders 26 causes the rod portions 26*a* thereof to be extended therefrom causing the boom assembly 22 to be raised. It should be pointed out at this point because views 1 and 2 are side elevational views that the complete boom structure 22 is not shown, but it will be understood by those skilled in the art and familiar with front-end loaders of the type disclosed herein that such a boom structure includes a pair of boom arms, each arm disposed upon a respective side of the loader and movable up and down along respective sides of the loader in response to actuation of the hydraulic lift cylinders 26**.

Disposed about the forward remote end of the boom assembly 22 is a connecting assembly that enables the boom structure to connect to a working implement. Referring to the connecting assembly in more detail, it is seen that the same comprises a pair of lift arms 28 fixed to the forward portion of the boom structure and extending generally downwardly therefrom. Mounted forwardly of the lift arms 28 and particularly pivotably mounted to the forward end portion of the boom 20 is a pair of hydraulic tilt cylinders 30 that in operation connect to the working implement and are utilized to control the angle or tilt of the implement during operation. Although it is expressly stated herein that the connecting assembly comprises a pair of lift arms 28 and a pair of tilt hydraulic cylinders 30, because of the side elevational views of FIGS. 1 and 2, only one of each is shown. But it will be appreciated by those skilled in the art that the boom assembly 22 is provided with a pair and that the pair as viewed from the front of the loader 10 is laterally spaced apart so as to connect on two sides of the particular working implement involved.

Now turning to the earthworking attachment of the present invention that together with loader 10 comprises, for the purpose of demonstrating a preferred embodiment, an earthworking implement, it is seen that the earthworking attachment shown that is adapted to be connected to the loader's boom structure 22 is referred to generally in the drawings by the numeral 32. Referring to the earthworking attachment 32 in greater detail, it is seen that the same basically comprises a frame structure indicated generally by the numeral 34 that includes a pair of side members 36 and 38 having a ground engaging roller 40 rotatively journaled transversely thereacross about a shaft 42 that is supported in respective bearing assemblies bolted to the inside walls of the side members 36 and 38. Ground engaging roller 40 is sometimes referred to as a tamping or compacting roller and is adapted to rotate about the transverse axis of shaft 42 that supports the roller between said side members 36 and 38. Ground engaging roller 40 generally includes a relatively smooth cylindrical outer surface **40*a*** that during operation engages the underlying ground, dirt or soil material.

Figure 4:
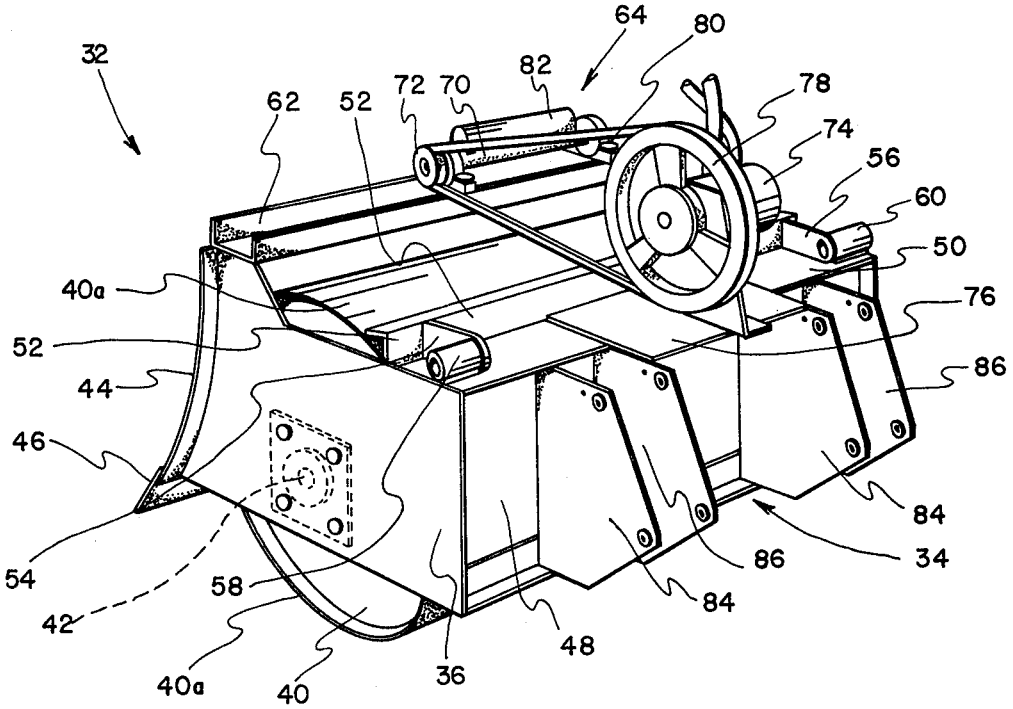
FIG. 4 is a perspective view of the same earthworking attachment shown in FIGS. 1 through 3, as viewed from the rear and to one side.

In continuing to refer to the frame structure 34 of the earthworking attachment 32, as particularly seen in FIGS. 3 and 4, it is seen that extending transversely across the front of the side members 36 and 38 is a blade 44, generally concave shaped as shown in the preferred embodiment, with said blade including a lower cutting edge 46. Blade 44 may be secured to side members 36 and 38 by weldment or other suitable means to form a very sturdy and strong structure that will withstand the conditions of ordinary operation. Tending to close the frame structure 34 about the ground engaging roller 40 is a rear transverse member 48 that extends between the rear inner edges of the side members 36 and 38 and is disposed generally below a horizontal support member 50 that extends transversely across the top rear portion of the frame structure 34.

Supported by the horizontal support member 50 is a cleaning member 52, in the form of an angle iron structure that extends transversely across the frame structure 34 in close proximity to the outer cylindrical surface **40*a* of the ground engaging roller 40. Cleaning member 52 includes an edge that is closely disposed adjacent the circumference of the ground engaging roller such that any accumulation of dirt or debris during the operation of the earthworking attachment of the present invention is stripped or cleaned from the roller in the process of operation. Cleaning members 52 is supported by a pair of arms 54 and 56 that are laterally spaced and extend therefrom to where a pivot assembly extends through a pair of laterally spaced collars 58 and 60 disposed on the horizontal support member 50 in appropriate spaced apart relationship. Therefore, it is seen that in cases where large clods of dirt or debris are accumulated and are very hard that it is possible for the cleaning member 52 to rotate about the axis of the pivot assemblies rotatively supported within the collars 58 and 60 to avoid damage to cleaning member 52**.

Referring to the front portion of the frame structure 34, it is seen that there is provided a transversely extending channel iron support 62. Channel iron support 62 is again secured by weldment or other suitable means to side members 36 and 38, and supported about said channel iron support 62 is a counterweight assembly or means indicated generally by the numeral 64 for selectively imparting a vibratory like massaging action to said frame structure 34 and ground engaging roller 40 carried thereby. Viewing the counterweight assembly 64 in greater detail, it is seen that the same includes a pair of spaced apart bearing assemblies 66 and 68 secured in lateral spaced apart relationship on said channel iron support 62 and including a shaft 70 rotatively journaled therein, said shaft including a drive sheave 72 fixed to one end thereof. Extending from shaft 70 along the longitudinal axis thereof is a particular size and shape counterweight 82 that extends in an off-set fashion.

In order to drive the counterweight assembly 64, there is provided a hydraulic motor 74 supported by a support plate 76 disposed on and secured to said horizontal support member 50. Operatively connected to hydraulic motors 74 and driven thereby is a drive wheel 78 that includes a drive belt 80 trained therearound, with the drive belt continuing to extend around and in driving relationship with sheave 72 disposed and fixed to one end of shaft 70. In operation, the hydraulic motor 74 via the hoses associated therewith is connected to an appropriate hydraulic control valve associated with the prime mover or loader 10 and by selectively actuating said valve, hydraulic fluid under pressure is directed to hydraulic motors 74 and consequently counterweight assemblies 64 is driven.

In order to connect the earthworking attachment 32 to a prime mover such as the loader 10 shown herein, the back member 48 of the frame structure 34 is provided with two sets of attaching plates, each set of attaching plates including plates 84 and 86. Attaching plates 84 and 86 of each attaching plate set is secured to back member 48 and extend generally rearwardly therefrom where each set of plates is adapted to receive and connect to a lift arm 28 and a hydraulic tilt cylinder 30 comprising the connecting assembly of the loader's boom structure 22. Although details are not particularly shown, it is appreciated that the lower remote ends of the lift arms 28 and tilt hydraulic cylinders 30 are coupled between respective attaching plates 84 and 86 by conventional connecting pin assemblies that extends through transversely aligned openings formed within the connecting plates 84 and 86. Consequently when connected, the boom structure through the connecting assembly just referred to (i.e., connecting arms 28 and tilt cylinders 30) acts to support and control the earthworking implement 34 of the present invention.

In operations, it is appreciated that because roller 40 is rotatively mounted within the frame structure 34, that the frame structure of the earthworking implement 32 may be rotated about the transverse axis of the shaft 42 supporting the roller 40.

As pointed out hereinbefore, the earthworking implement or attachment of the present invention has the capability to form two basic earthworking functions. First, as illustrated in FIG. 1, frame structure 34 can be tilted with respect to the roller 40 such that the blade 44 assumes a position where the lower cutting edge 46 thereof generally engages the ground G at a level near the level assumed by the lower portion of the roller 40. In this position, the blade can be used to spread and level dirt or soil material in various types of earthworking operations, particularly those operations where a ditch or trench is being filled. By driving the loader 10 back and forth, the lower edge portion of the blade 44 engages the dirt and soil material about the ground G and the resulting effect is that the blade acts to level and spread the dirt or soil material.

With regard to this first basic dirt and soil spreading and leveling function and as particularly illustrated in FIG. 1, the boom structure 22 is raised to a certain desired height and the tilt control hydraulic cylinders 30 are extended to where the blade 44 is angled or pitched to a desired position.

The second basic function that the earthworking attachment or implement of the present invention is capable of performing relates to a tamping or compacting action on the soil. In the preferred embodiment and in the cases described herein, it is preferable to tamp, or compact the dirt or soil material after the same has been loosely spreaded or leveled over a certain area. In this mode of operation, the blade 44 is moved to a raised or second position, as illustrated in FIG. 2, where the lower edge thereof is spaced upwardly from the ground surface G. This is accomplished by manipulating the boom structure 22 and particularly positioning the tilt control hydraulic cylinders 30 to properly position the frame structure 34 in accordance with the illustration in FIG. 2. Also, it should be pointed out to achieve the tamping action on the dirt or soil underlying the roller 40 that the control valve controlling hydraulic motor 74 is actuated causing fluid to flow thereto and the drive wheel 78 to be driven. Torque from the drive wheel 78 is transferred to the counterweight assembly 64 which causes a vibratory like massaging action to be applied to the frame structure 34 as well as the roller 40 rotatively carried thereby. Consequently, when this vibratory, massaging action is being applied to the roller and the same is engaging the ground G while the loader is being driven, it is appreciated that a tamping or compacting action is given to the underlying dirt or soil material.

It consequently follows that the operator of the loader 10 can alternate between the leveling and tamping operations as he so desires. It is important to realize that each operation can be performed independently of the other in accordance with the present disclosure as described hereinbefore. Also, there may be occasions where it would be desirable to conduct both the leveling and tamping operations simultaneously. If this is the case, those skilled in the art will appreciate that the earth-working implement or attachment of the present invention will allow this.

From the foregoing discussion, it is apparent that the present invention presents a very versatile and useful earth-working implement or attachment that may be used for both leveling operations such as filling a trench or ditch or even just a general spreading or leveling operation, in addition to the tamping or compacting function. Besides this, the earthworking implement or attachment of the present invention is relatively simple, easy to operate, and as an attachment can be conveniently connected and disconnected to a prime such as a tractor or front-end loader.

The terms "upper", "lower", "forward", "rearward", etc., have been used herein merely for the convenience of the foregoing specification and in the appended Claims to describe the earth-working implement and its parts as oriented in the drawings. It is to be understood, however, that these terms are in no way limiting to the invention since the earthworking implement may obviously be disposed in many different positions when in actual use.

The present invention, of course, may be carried out in other specific ways than those set forth without departing from the spirit and essential characteristics of the invention. The present embodiments are, therefore, to be considered in all respects as illustrative and not restrictive, and all changes coming within the meaning and equivalency range are intended to be embraced herein.

What is claimed is:

1. An earthworking implement comprising:

a. a prime mover;

b. power actuated boom means secured to said prime mover and extending forwardly thereof and movable between a lower position and a raised position;

c. a frame structure secured to said boom means and including a pair of laterally spaced side members and blade means extending forwardly across said side members;

d. an earth tamping roller rotatively mounted rearwardly of said blade means about a transverse axis between said side members of said frame structure;

e. said frame structure further including a rear attaching assembly mounted on the rear portion of said frame structure and including attaching means extending therefrom and connected to said boom means;

f. said frame structure being pivotably mounted about said transverse axis of said earth tamping rollers such that said blade means may be moved from a first lower earth leveling position to an upper inoperative position; and g. counterweight means rotatively mounted on said frame structure and drive means for driving said counterweight means so as to impart a vibrating like massaging action to said earth tamping roller supported within said frame structure such that said earth tamping roller may be used to compact earth that is passed over thereby, whereby said earthworking implement may perform an earth leveling operation or an earth tamping operation wherein either operation may be performed independently of the other by selectively pivoting said frame structure between said first and second positions about the transverse axis of rotation of said earth tamping roller.

2. The earthworking implement of claim 1 wherein said rear attaching assembly on said frame structure includes a set of attaching plates on each rear side of said frame structure, each set of attaching plates receiving and connecting with a lift arm and a tilt control hydraulic cylinder extending from said boom means, whereby the position of said frame structure and said blade means thereof with respect to said earth tamping roller can be controlled by said boom means through the respective lift arms and hydraulic tilt control cylinders extending therefrom.

3. The earthworking implement of claim 2 wherein said counterweight means includes a shaft rotatively journaled on said frame structure and including a counterweight fixed to and extending from a portion thereof in off-set fashion; and wherein the drive means of said counterweight means includes a hydraulic drive motor mounted on said frame structure and hydraulically driven from said prime mover, and interconnecting drive means connected between said hydraulic motor and said shaft for rotatively driving said counterweight means.

4. The earthworking implement of claim 1 wherein said frame structure is provided with a roller cleaning member extending transversely across said frame structure in close proximity to said roller for cleaning and removing dirt and debris that may accumulate on the roller during operation as the roller moves over the underlying earth.

5. The earthworking implement of claim 4 wherein said prime mover comprises a front end loader, and wherein said boom means is secured to said prime mover about a transverse axis and is rotatable thereabout, said boom means extending generally forwardly from said transverse axis of rotation where said boom means may be actuated between said lower and raised positions by hydraulic cylinder means operatively connected between said front end loader and said boom means, and wherein said means for pivoting said frame structure about the transverse axis of rotation of said earth tamping roller includes a pair of lift arms and a pair of hydraulic tilt cylinders operatively connected between said boom means and said frame structure and wherein said hydraulic tilt cylinders cooperate with said lift arms for selectively moving said blade means between said first lower earthleveling position and said upper and inoperative position.

6. A combination earthworking implement for leveling and spreading dirt or soil making up earth material and tamping the level or spreaded earth material, said earthworking implement being adapted to be operatively connected to a tractor, front-end loader or the like and comprising: a frame structure; ground engaging roller means rotatively mounted within said frame structure; said frame structure including a pair of laterally spaced side members having said ground engaging roller means rotatively supported therebetween and blade means extending forwardly across said side members forwardly of said ground engaging roller means; said frame structure further including a rear attaching assembly extending transversely across the rear portion of said frame structure and including attaching means extending therefrom and adapted to be connected to a prime mover; said frame structure being rotatable about the axis of said ground engaging roller such that said blade means may be moved from a first lower leveling or spreading position to a second elevated inoperative position above the level of the earth; counterweight means rotatively mounted on said frame structure; and drive means for selectively driving said counterweight means such that a vibratory like massaging action is imparted to said frame structure and said ground engaging roller means associated therewith such that said ground engaging roller can be used to engage the underlying earth and because of the vibratory-massage like action being imparted to said ground engaging roller means the same generally acts to compress and massage the underlying earth as the ground engaging roller means passes thereover while the counterweight means is being driven.

7. The combination earthworking implement of claim 6 wherein said frame structure is provided with a transverse roller cleaning member disposed in close proximity to an outer cylindrical surface of said ground engaging roller for cleaning and removing dirt and debris therefrom that may accumulate during operation.

8. The combination earthworking implement of claim 7 wherein said drive means for driving said counterweight means includes a hydraulic motor operatively driven by the connected prime mover, said hydraulic motor being operative to drive a drive wheel connected thereto wherein said drive wheel is in turn operative to drive said counterweight means through a drive belt that is trained around a drive sheave connected to a shaft that forms a part of said counterweight means, said shaft being rotatively journaled on said frame structure and including a counterweight fixed to and extending therefrom in off-set relationship to the axis of said shaft.

* * * * *